US005781092A

United States Patent [19]

Nakamichi et al.

[11] Patent Number: 5,781,092

[45] Date of Patent: Jul. 14, 1998

[54] IGNITION COIL FOR AN INTERNAL COMBUSTION ENGINE

[75] Inventors: Kazutaka Nakamichi; Kouji Yoshikawa, both of Obu; Katsuji Ishikawa, Hekinan; Toshiro Suzuki, Nissin; Hitoshi Takeuchi, Chita, all of Japan

[73] Assignee: Aisan Kogyo Kabushiki Kaisha, Obu, Japan

[21] Appl. No.: 658,377

[22] Filed: Jun. 5, 1996

[30] Foreign Application Priority Data

Jun. 9, 1995 [JP] Japan ..... 7-168325
Jun. 15, 1995 [JP] Japan ..... 7-172853

[51] Int. Cl.[6] ..... H01F 77/04

[52] U.S. Cl. ..... 336/96; 174/29; 336/107

[58] Field of Search ..... 336/92, 96, 107, 336/205; 174/29, 47; 123/634

[56] References Cited

U.S. PATENT DOCUMENTS

| | | | |
|---|---|---|---|
| 3,236,937 | 2/1966 | Harkness etal. | 336/96 |
| 3,905,001 | 9/1975 | Sato et al. | 336/96 |
| 4,763,094 | 8/1988 | Kojima . | |
| 5,170,767 | 12/1992 | Wada et al. | 336/96 |
| 5,271,373 | 12/1993 | Takaishi et al. | 336/96 |
| 5,349,320 | 9/1994 | Suzuki et al. | 336/92 |
| 5,357,233 | 10/1994 | Wada | 336/107 |

FOREIGN PATENT DOCUMENTS

| | | | |
|---|---|---|---|
| 1-294308 | 11/1989 | Japan | 174/29 |
| A-6-77066 | 3/1994 | Japan . | |
| A-6-137249 | 5/1994 | Japan . | |

*Primary Examiner*—Thomas J. Kozma
*Attorney, Agent, or Firm*—Oliff & Berridge, P.L.C.

[57] ABSTRACT

The invention is directed to an ignition coil for an internal combustion engine which includes a first case which has at least an opening portion at its bottom, a primary winding and a secondary winding which are received in the first case, a secondary terminal which is electrically connected to the secondary winding and placed within the first case in the vicinity of the opening portion at the bottom of the first case, and a second case which has a cover portion connected with the opening portion at the bottom of the first case, and which has a cylindrical portion extending from the cover portion. The ignition coil further includes a high-tension terminal which has a shaft held on a central axis of the cylindrical portion of the second case, and which is electrically connected to the secondary terminal. Then, a synthetic resin is filled in the first case and the second case connected therewith so as to fix and insulate the primary winding, secondary winding, secondary terminal and high-tension terminal. The first case may have a second opening portion at its one side, so that the synthetic resin is filled into the first case and the second case, through the second opening portion.

7 Claims, 10 Drawing Sheets

IGNITION COIL FOR AN INTERNAL COMBUSTION ENGINE

BACKGROUND OF THE INVENTION

1. Field of the Invention

The present invention relates to an ignition coil for use in an internal combustion engine, more particularly to an ignition coil having a primary winding, a secondary winding and a high-tension terminal received in a housing with a synthetic resin filled therein.

2. Description of the Related Arts

A conventional ignition coil for an internal combustion engine is provided with a primary winding and a secondary winding which are disposed around a core, respectively. The primary winding is electrically connected to a control circuit for controlling a primary current, and the secondary winding is electrically connected to an ignition plug through a high-tension terminal. In Japanese Patent Laid-open Publication No. 6-77066, for example, there is disclosed an ignition coil which includes a first core received in a case, a second core arranged in a certain place relative to the first core to form a magnetic path together with the first core, a primary winding and a secondary winding wound around the second core. The ignition coil further includes a primary bobbin which accommodates the second core, and around which at least the primary coil is wound, a connecting portion which is connected to the primary bobbin and provided with a primary terminal for connecting with a wire of the primary winding, a connector portion which is connected to the connecting portion and provided with a connector terminal for connecting with at least the primary terminal, thereby to form a primary coil assembly. This primary coil assembly is disposed in the case so that at least a portion of the first core is placed in a space which is defined by the primary bobbin, the connecting portion and the connector portion. According to the ignition coil disclosed in the publication, number of parts can be reduced, and connection between the first core received in the case and the second core accommodated in the primary bobbin can be made easily and appropriately. Thus, the coil can be assembled into an ignition coil adequately.

The ignition coil as disclosed in the above-identified publication is connected to an ignition plug through a plug socket as disclosed in Japanese Patent Laid-open Publication No. 6-137249, for example. In this publication, a plug socket 10 includes an upper cap 22 for connecting with a tower 2 (i.e., a high-tension connector portion), a conductive peripheral portion 25 and a lower cap 26 connected with an ignition plug 4, and a plurality of protrusions 28 formed around it. The plug socket 10 also includes therein a leaf spring 14, a conductive member 11 and a coil spring 18, through which a high-tension output terminal 3 is connected with the ignition plug 4.

According to the ignition coil as disclosed in the Publication No. 6-77066, a secondary connector portion for supporting a high-tension terminal, i.e., a high-tension connector portion (may be referred to as a high-tension tower), is integrally formed with a case, and this high-tension connector portion is connected to the ignition plug through the plug socket as disclosed in the Publication No. 6-137249. Since the plug socket 10 is provided with the leaf spring 4, the conductive member 11 and the coil spring 18, as mentioned above, the leaf spring 4 and the conductive member 11 may be formed by a single conductor to provide a high-tension terminal, thereby to reduce the number of parts. In this case, however, the high-tension terminal has to have a long shaft, so that it is very difficult to hold the high-tension terminal on a central axis of the plug socket 10.

The plug socket 10 as disclosed in the Publication No. 6-137249 has the conductive peripheral portion 25 whose diameter is smaller than the diameters of the upper cap 22 and the lower cap 26, and which is formed in the middle of them. Therefore, when manufacturing the plug socket 10 as disclosed in the publication, in addition to an upper die "UD" as shown in FIG. 13, lower dies "LD1", "LD2" which are divided along the central axis of the plug socket 10, are needed. As a result, the number of products produced by a single manufacturing operation is limited to cause a cost increase. If the plug socket 10 is produced without making the conductive peripheral portion 25 to be of the smaller diameter, by means of a pair of dies which were divided by a horizontal surface for separating the plug socket 10 into upper and lower portions, a plurality of products will be produced by a single operation. In this case, however, rubber is high in price as a material forming the plug socket, it will cause a cost increase. On the contrary, if the conductive member 11 is made larger in diameter, the amount of rubber material for producing the plug socket 10 will be reduced. However, an electrostatic capacity of the member 11 will be increased, so that an output power will be reduced.

According to the ignition coil as disclosed in the Publication No. 6-77066, on an upper surface of the case, i.e., the opposite side to the high-tension connector portion, there is formed an opening portion for introducing a resin into the case. In order to provide the opening portion, a top portion of the case has to be made larger than that of a desired configuration, because a position and size of the opening portion are limited in view of a direction of removing a die when molding the case and the high-tension connector portion integrally. Otherwise, the opening portion has to be made only on one side of the case which may be made by a pair of dies separated by a vertical surface into left and right dies. According to the ignition coil having such opening portion, however, even if the left side of the top portion of the case can be made in conformity with a part of a spherical configuration, for example, the right side of the top portion can not be made in conformity with a remaining part of the spherical configuration, so that an unnecessary portion remains. Therefore, the amount of resin material is excessive in that ignition coil, and it is difficult to minimize the ignition coil.

SUMMARY OF THE INVENTION

Accordingly, it is an object of the present invention to provide an ignition coil for an internal combustion engine, wherein a primary winding and a secondary winding are received in a first case, a high-tension terminal is properly supported in a second case connected with the first case, and a synthetic resin is filled into the first and second cases.

It is another object of the present invention to provide an ignition coil which includes a first case for receiving therein a primary winding and a secondary winding, a second case connected with the first case, and a synthetic resin filled into the first and second cases through an opening portion adapted to provide a desired configuration of the first case.

In accomplishing these and other objects, an ignition coil for an internal combustion engine includes a first case having at least an opening portion at its bottom, a primary winding and a secondary winding received in the first case, a secondary terminal electrically connected to the secondary winding and placed within the first case in the vicinity of the opening portion at the bottom of the first case, and a second case having a cover portion connected with the opening portion at the bottom of the first case, and a cylindrical portion extending from the cover portion. The ignition coil further includes a high-tension terminal having a shaft held on a central axis of the cylindrical portion of the second case, and electrically connected to the secondary terminal. Then, a synthetic resin is filled in the first case and the second case connected therewith so as to fix and insulate the primary winding, secondary winding, secondary terminal and high-tension terminal.

Preferably, the second case may include at least three ribs spaced apart evenly around an inner periphery of the cylindrical portion, and it may be so arranged that the ribs extend from the inside of the cylindrical portion toward the central axis thereof, and holds the high-tension terminal on the central axis of the cylindrical portion.

The ignition coil may further comprise a connection terminal, one end of which connects to the secondary terminal, and an opposite end of which extends toward the opening portion at the bottom of the first case and connects to the high-tension terminal.

It may be so arranged that the first case has a second opening portion at one side of the first case, and that the synthetic resin is filled into the first case and the second case connected therewith, through the second opening portion of the first case.

The ignition coil may further comprise a cylindrical insulating member which encloses the cylindrical portion of the second case, and it may be so arranged that an outer diameter of at least a part of the cylindrical insulating member is gradually reduced from its one end placed near the first case toward its opposite end thereby to provide a tapered surface.

BRIEF DESCRIPTION OF THE DRAWINGS

The above stated objects and following description will become readily apparent with reference to the accompanying drawings, wherein like reference numerals denote like elements, and in which.

DESCRIPTION OF THE PREFERRED EMBODIMENT

Figure 1:
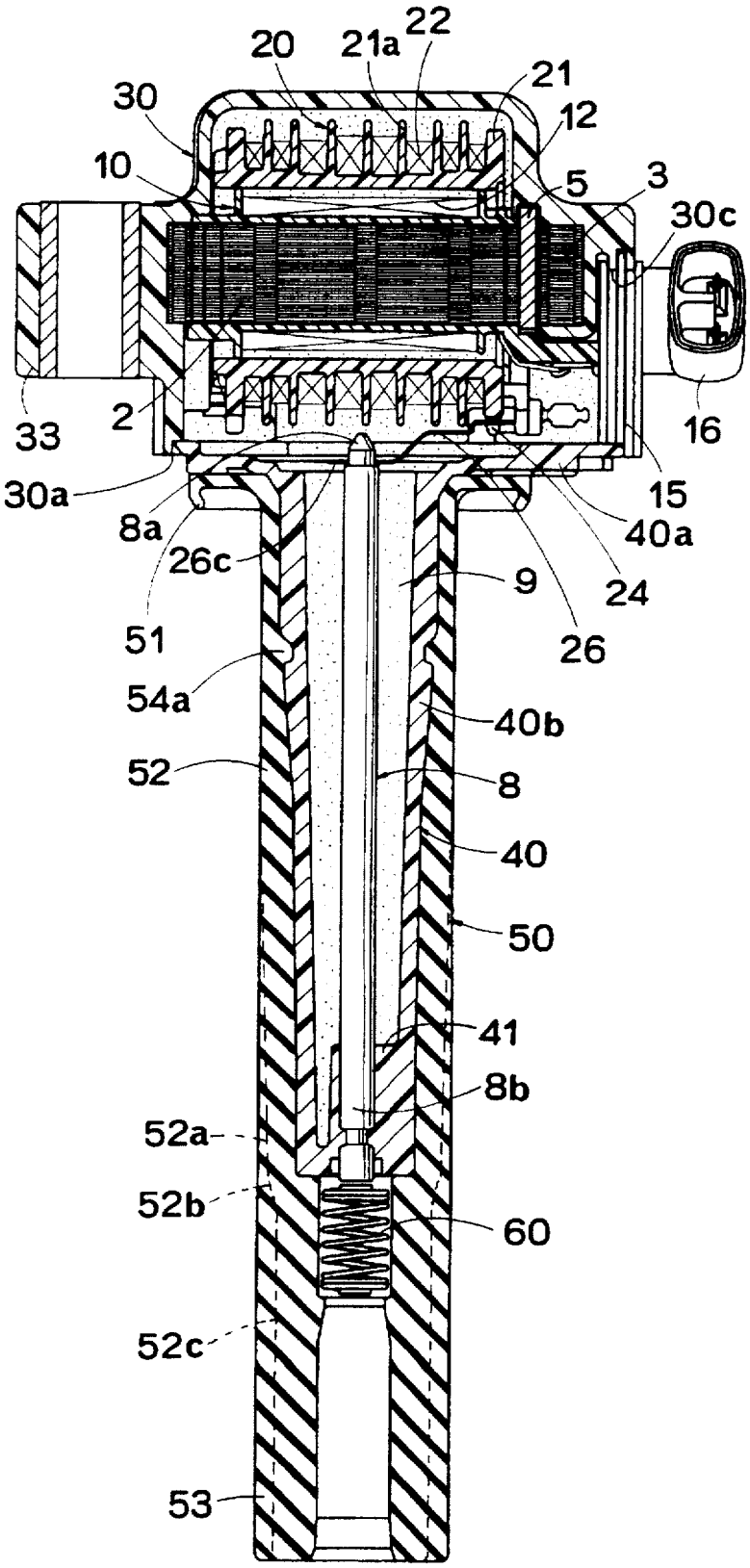
FIG. 1 is a vertically sectioned view of an ignition coil for an internal combustion engine according to an embodiment of the present invention.
Figure 2:
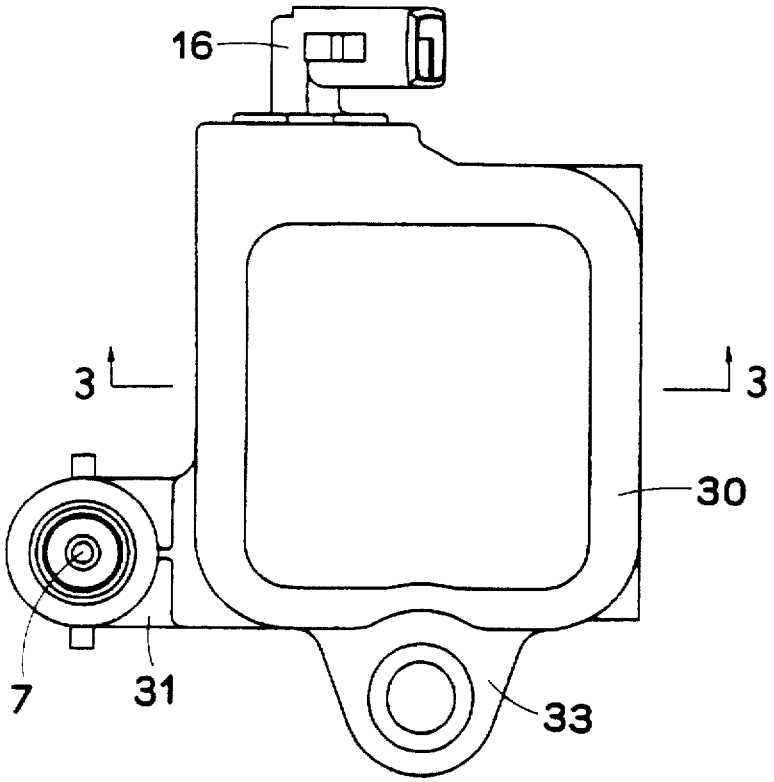
FIG. 2 is a plan view of the ignition coil according to the embodiment of the present invention.
Figure 3:
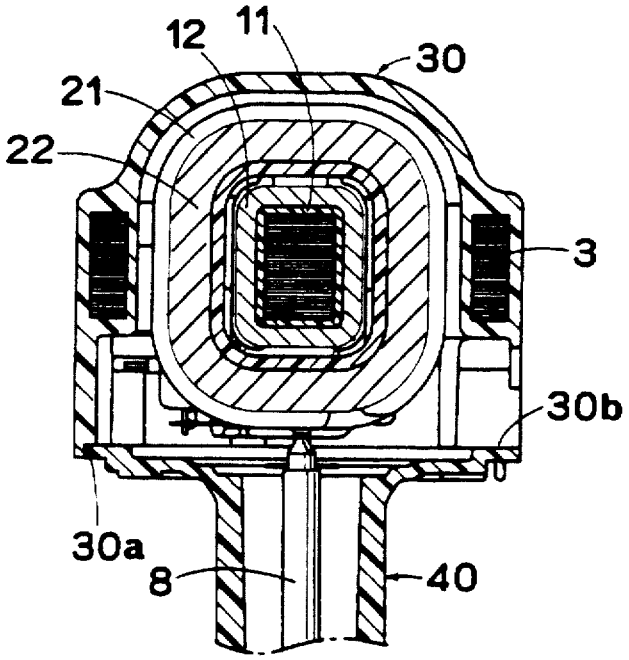
FIG. 3 is a partially sectioned view of a part of the ignition coil according to the embodiment of the present invention, and sectioned along 3—3 line in FIG. 2.
Figure 4:
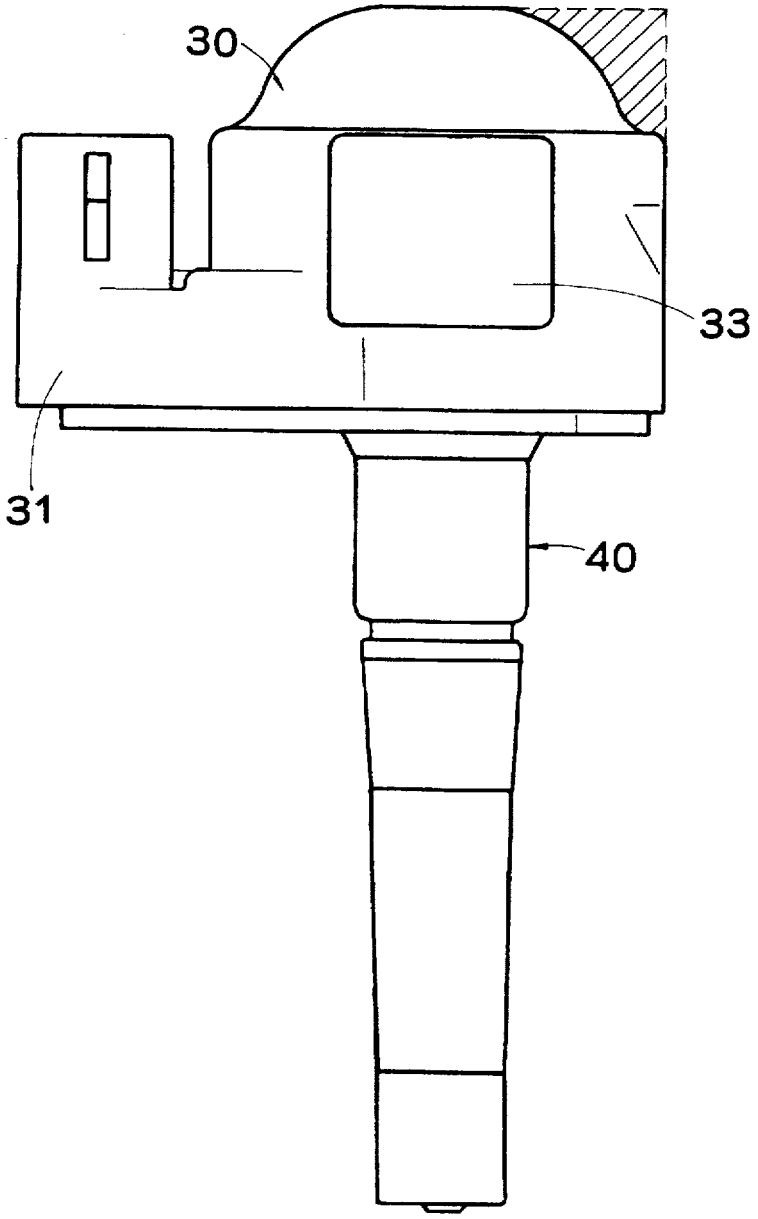
FIG. 4 is a side view of the ignition coil according to the embodiment of the present invention.
Figure 5:
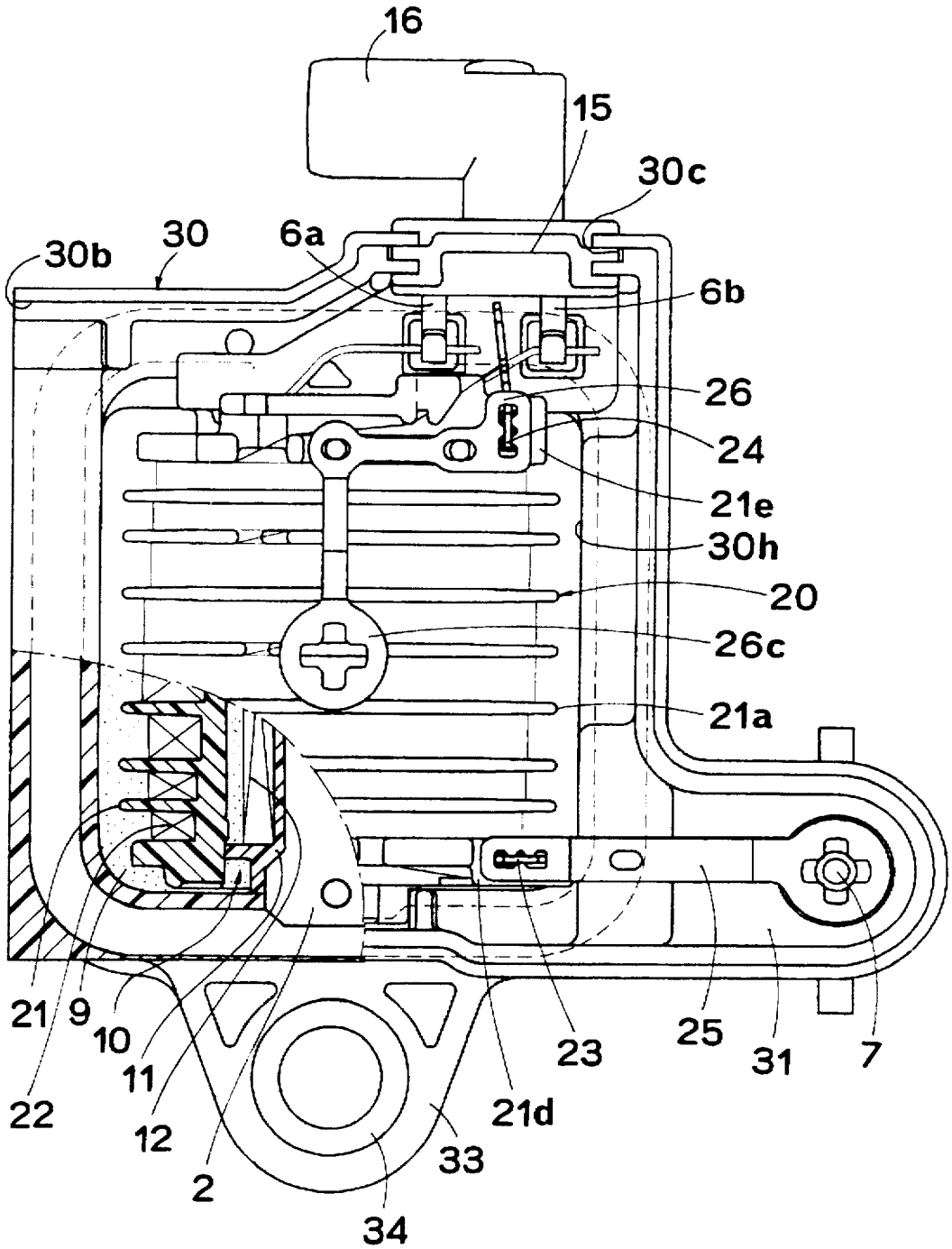
FIG. 5 is a partially sectioned plan view of a bottom of an upper case according to the embodiment of the present invention.
Figure 6:
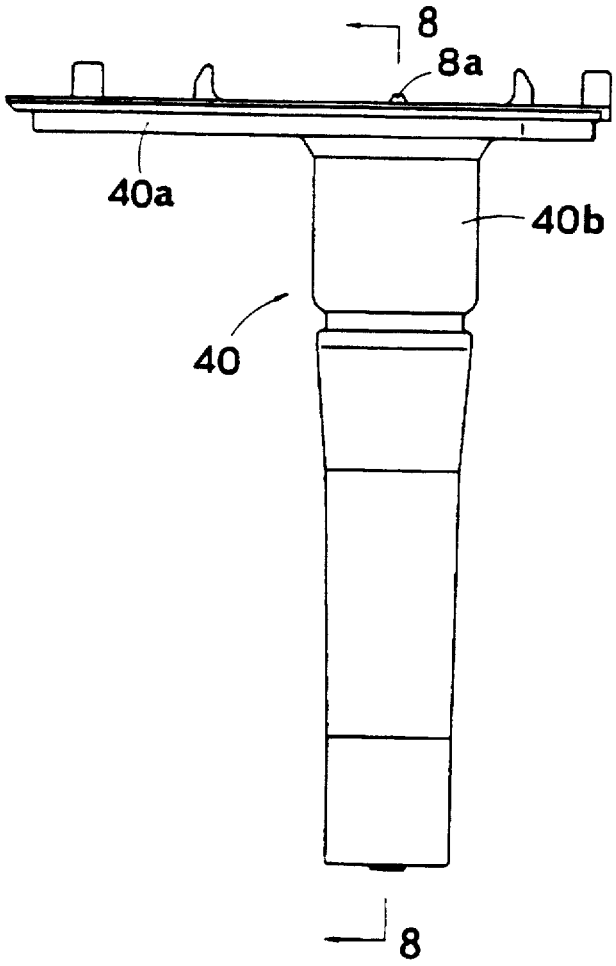
FIG. 6 is a side view of a lower case according to the embodiment of the present invention.
Figure 7:
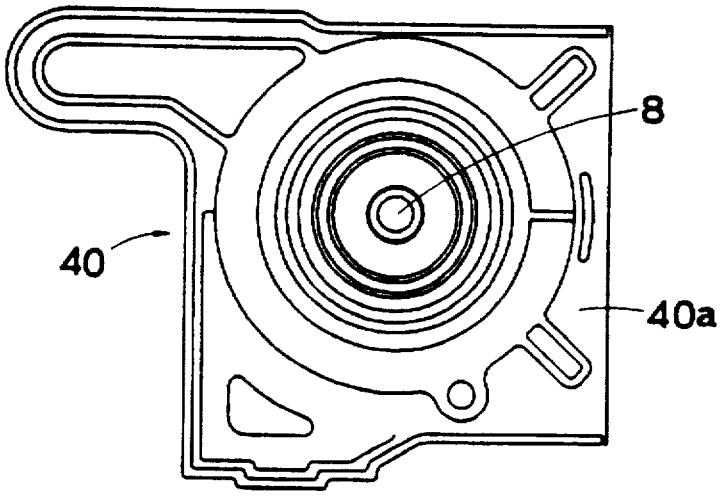
FIG. 7 is a bottom view of the lower case according to the embodiment of the present invention.
Figure 8:
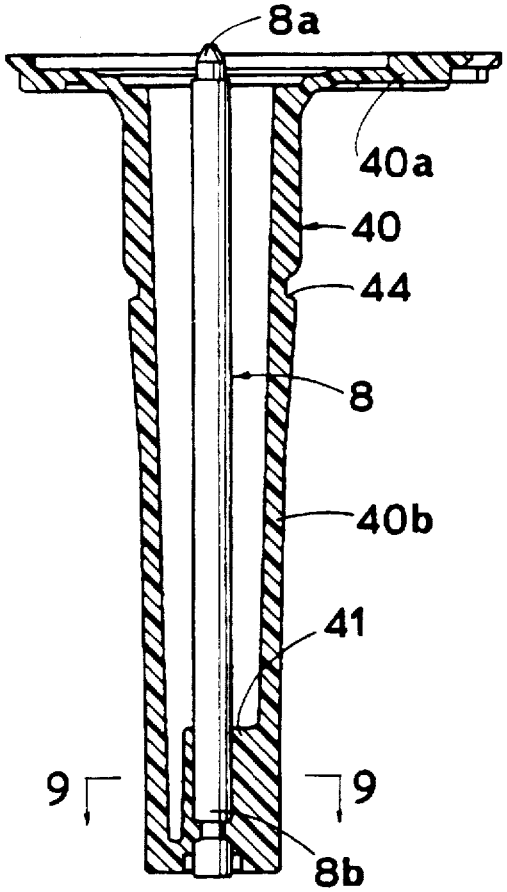
FIG. 8 is a sectional view of the lower case according to the embodiment of the present invention, and sectioned along 8—8 line in FIG. 6.
Figure 9:
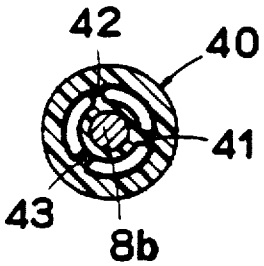
FIG. 9 is a sectional view of the lower case according to the embodiment of the present invention, and sectioned along 9—9 line in FIG. 8.
Figure 10:
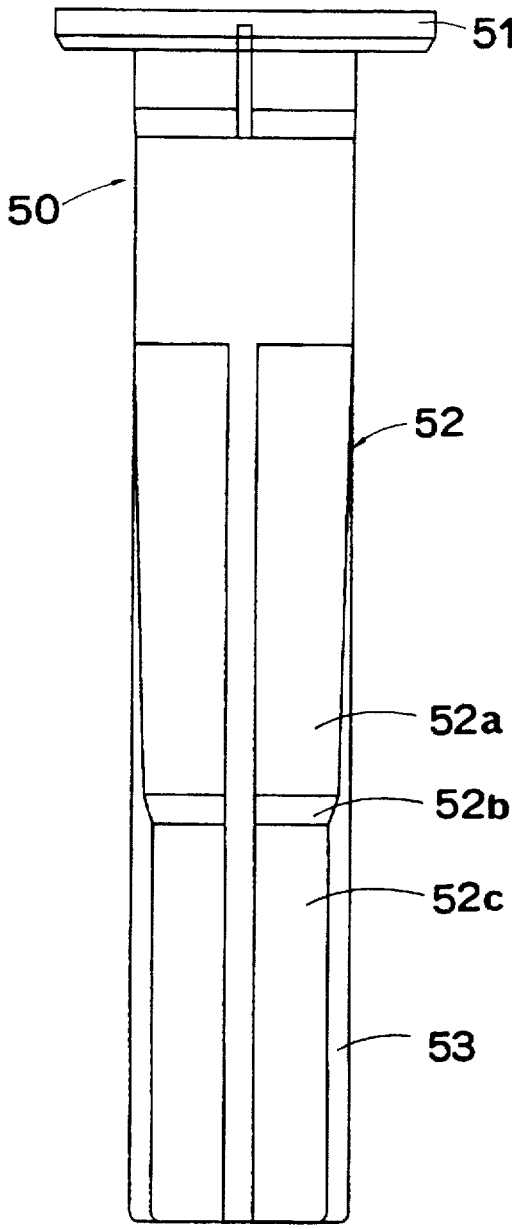
FIG. 10 is a front view of a plug socket according to the embodiment of the present invention.
Figure 11:
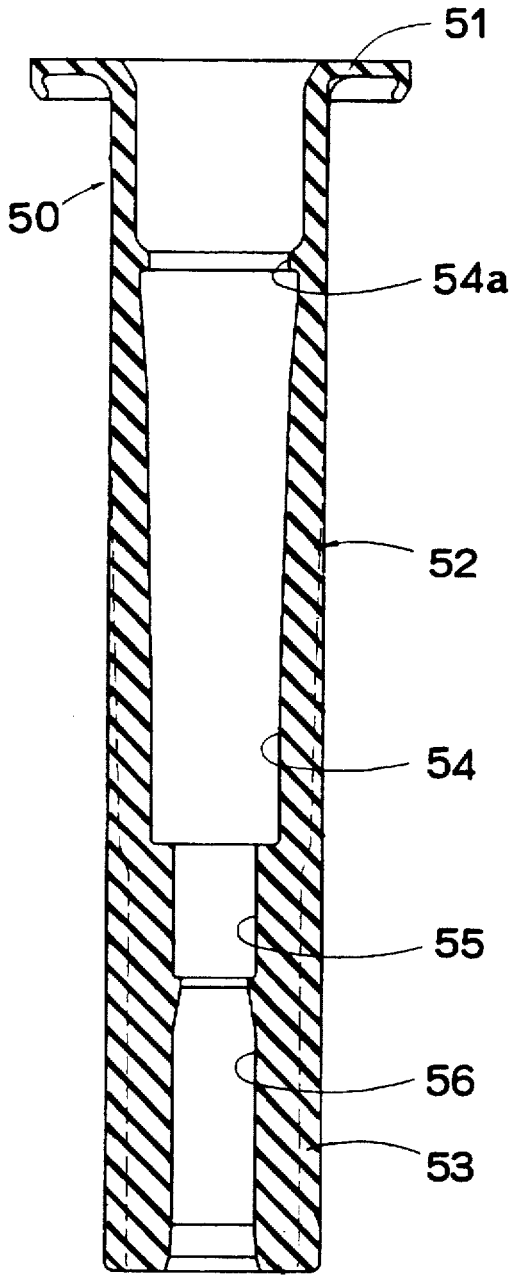
FIG. 11 is a vertically sectioned view of the plug socket according to the embodiment of the present invention.
Figure 12:
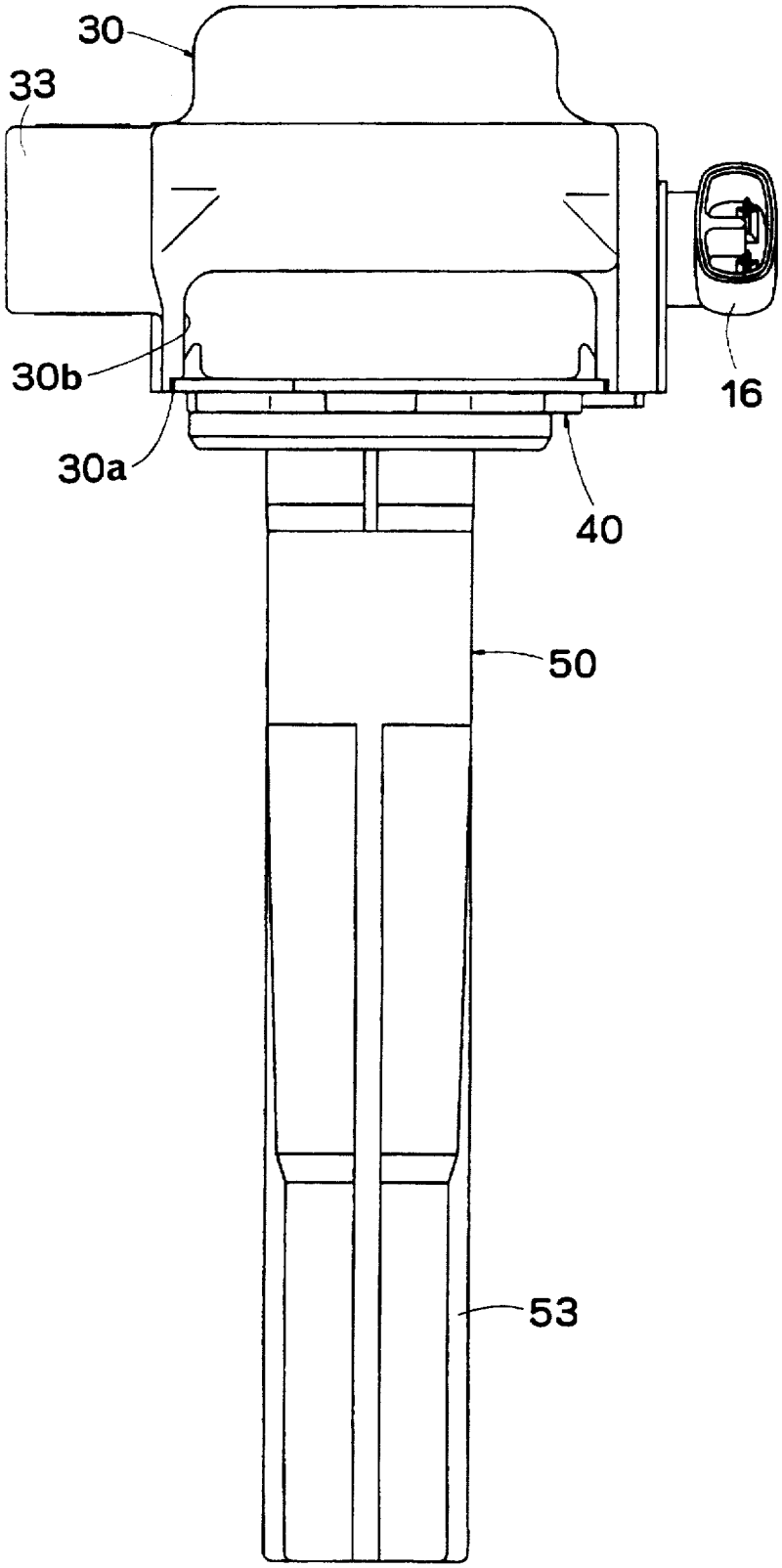
FIG. 12 is a front view of the ignition coil according to the embodiment of the present invention.

Referring to FIGS. 1 and 12, there is illustrated an ignition coil of a simultaneous ignition system (sometimes referred to as a double ignition system) according to an embodiment of the present invention. A housing of the present embodiment includes an upper case 30 and a lower case 40 which are combined together. FIG. 5 illustrates a structure of the upper case 30 which receives an primary coil assembly 10 and a secondary coil assembly 20 associated therewith. FIGS. 6–9 illustrate the lower case 40 which is connected with the upper case 30 as shown in FIGS. 2–4. FIGS. 10 and 11 illustrate a plug socket 50 which serves as a cylindrical insulating member according to the present invention, and which is mounted on the lower case 40, as shown in FIGS. 1 and 12.

The upper case 30, which serves as a first case according to the present invention, is a box-like case made of synthetic resin such as polybutylene terephthalate (PBT), and a core 3 is molded integrally with the case 30 by insert molding. The upper case 30 has an opening portion 30*a* at its bottom to be connected with the lower case 40 and an opening portion 30*b* at its one side. The primary coil assembly 10 and the secondary coil assembly 20 are received in the upper case 30. A high-tension terminal portion 31 extends from a side opposite to the opening portion 30*b* as shown in FIG. 5, and a high-tension terminal 7 is received in the high-tension terminal portion 31. There is formed on the upper side of the upper case 30 in FIG. 5 an opening portion 30*c* into which a support portion 15 is fitted, and a flange portion 33 extends from the lower side in FIG. 5 opposite to the opening portion 30*c*. A collar 34 is embedded in the flange portion 33 by insert molding.

As shown in FIGS. 1 and 5, a primary winding 12 is wound around a primary bobbin 11 to provide the primary coil assembly 10. That is, the primary winding 12 is disposed with its wire wound around the primary bobbin 11 made of synthetic resin to provide two or four layers thereon. The primary bobbin 11 accommodates therein a core 2, and includes a support portion 15 and a connector portion 16, on which a pair of primary terminals 6*a*, 6*b* are embedded. The primary bobbin 11 holds a permanent magnet 5 which is fixed to an end face of the core 2, as shown in FIG. 1. The secondary coil assembly 20 includes a secondary bobbin 21 and a secondary winding 22 disposed thereon. The secondary bobbin 21 is made of synthetic resin and formed into a cylinder with an approximately rectangular cross section. A plurality of collars (represented by 21*a*) are formed on the secondary bobbin 21 with a certain space between adjacent two of the collars 21*a* along the axis of the secondary bobbin 21. The wire of the secondary winding 22 is wound in each space between the collars 21*a*. Since the simultaneous ignition system is employed in the present embodiment, collars 21*d*, 21*e* formed at opposite ends of the collars 21*a* of the secondary bobbin 21 have a relatively broad width respectively, and the secondary terminals 23, 24 are embedded on the collars 21*d*, 21*e* at the opposite ends of the secondary bobbin 21, as shown in FIG. 5. The opposite ends of the wire of the secondary coil 22 are wound around the secondary terminals 23, 24 which are embedded on the collars 21*d*, 21*e*, and to which connection terminals 25, 26 are connected, respectively. One end of the connection terminal 25 is connected to the secondary terminal 23, and the other end is connected to the high-tension terminal 7. Another connection terminal 26 is connected to the secondary terminal 24 to extend in parallel with the axis of the secondary bobbin 21 as shown in FIG. 1. When the lower case 40 is assembled with the upper case 30 as described later, the connection terminal 26 is connected to a high-tension terminal 8 which is held in the lower case 40.

The upper case 30 has the opening portion 30*b* formed at one side, and the opening portion 30*c* at its opposite side, as shown in FIGS. 1 and 5, into which the support portion 15 is fitted. The connector portion 16 has the primary terminals 6*a*, 6*b* which extend into the inside of the upper case 30, and which are electrically connected to an outer connector (not shown) outside the upper case 30. The tip end portions of the primary terminals 6*a*, 6*b* are folded to connect the opposite ends of the wire of the primary winding 12, respectively. The upper case 30 is connected with the lower case 40 which serves as a second case according with the present invention. The lower case 40 includes a cover portion 40*a* and a cylindrical body portion 40*b* which extends from the cover portion 40*a* to provide a high-tension connector portion. Both of the cover portion 40*a* and the body portion 40*b* are made of synthetic resin as one body. As shown in FIGS. 8 and 9, at the bottom of the body portion 40*b* there are formed three ribs 41–43, by which a base end portion 8*b* of the high-tension terminal 8 is held. That is, the shaft-like high-tension terminal 8 is placed on the central axis of the body portion 40*b* and molded therewith by insert molding, and the base end portion 8*b* is held in the body portion 40*b*, with a boss portion 8*a* slightly extending out of a cover portion 40*a* (or, a surface connected to the upper case 30). The lower case 40 is produced by a die for molding it by resin. The die has three gates (not shown) which are provided at three positions corresponding to the three ribs 41–43 to introduce the resin for molding. Therefore, the lower case 40 may be formed by resin with the high-tension terminal 8 pressed at the positions evenly spaced around its periphery, so that the lower case 40 may be produced in such a condition that the high-tension terminal 8 is held on the central axis of the body portion 40*b*.

In the case where the above-described ignition coil is assembled, the secondary coil assembly 20 is assembled into the primary coil assembly 10, one end of the wire of the primary winding 12 is electrically connected to the primary terminal 6*a*, the other end of the wire is connected to the primary terminal 6*b*. More specifically, the opposite ends of the primary winding 12 are held by the folded portions of the primary terminals 6*a*, 6*b*, and soldered respectively, as shown in FIGS. 1 and 5. This is done before the primary and secondary coil assemblies 10 and 20 are received in the upper case 30, then the support portion 15 is fitted into the opening portion 30*c* of the upper case 30, and then the primary and secondary assemblies 10, 20 are received in the upper case 30. The upper case 30 and the lower case 40 are connected together as shown in FIG. 1, by means of adhesive, mechanical engaging means, thermal caulking means, or the like. After the upper case 30 and the lower case 40 are combined, a certain working tool (not shown) is inserted through the opening portion 30*b* to press the connecting portion 26*c* of the connection terminal 26 onto the boss portion 8*a* of the high-tension terminal 8, so that the secondary terminal 24 is electrically connected to the high-tension terminal 8 through the connection terminal 26. Thereafter, a thermosetting synthetic resin such as epoxy resin is filled into a space in the upper case 30 through the opening portion 30*b*, and set to form a resin portion 9 as indicated by dots in FIGS. 1 and 5. Thus, the upper case 30 and the lower case 40 are combined firmly, and the primary and secondary windings 12 and 22 are impregnated and made rigid with such resin, and the insulation is ensured to endure the high-tension output from the secondary winding 22. Especially, since the resin is filled into the cylindrical body portion 40*b* of the lower case 40 and the resin portion 9 is formed around the high-tension terminal 8, appropriate insulating property is obtained.

Before the above-described ignition coil of the simultaneous ignition system is installed in an internal combustion engine (not shown), a plug socket 50 is mounted on the lower case 40. The plug socket 50 has a configuration as shown in FIG. 10, and a section as shown in FIG. 11. The plug socket 50 is made of rubber to provide a seal portion 51 and a cylindrical body portion 52 which has four ribs (represented by 53) spaced apart evenly around the outer periphery of the body portion 52. Between the ribs 53 on the body portion 52 there are formed tapered surfaces 52*a*, 52*b*, 52*c*, outer diameters of which are gradually reduced from the seal portion 51 to the tip end. The tapered surfaces 52*a*, 52*b*, 52*c* are formed in accordance with the inner hollow portion of the body portion 52. That is, as shown in FIG. 11, the plug socket 50 has a hollow portion 54 corresponding to the outer configuration of the lower case 40, a hollow portion 55 for receiving a conductive spring 60 as shown in FIG. 1, and a hollow portion 56 to be fitted into the ignition plug (not shown). The plug socket 50 has an approximately equal thickness along its axis, with a diameter reduced as small as possible, keeping an appropriate strength, to provide its outer configuration as shown in FIG. 10. A protrusion 54*a* is provided in the body portion 52 to be fitted into a recess 44 (in FIG. 8) formed around the periphery of the lower case 40, so that the plug socket 50 is held on the lower case 40 as shown in FIG. 1.

Figure 13:
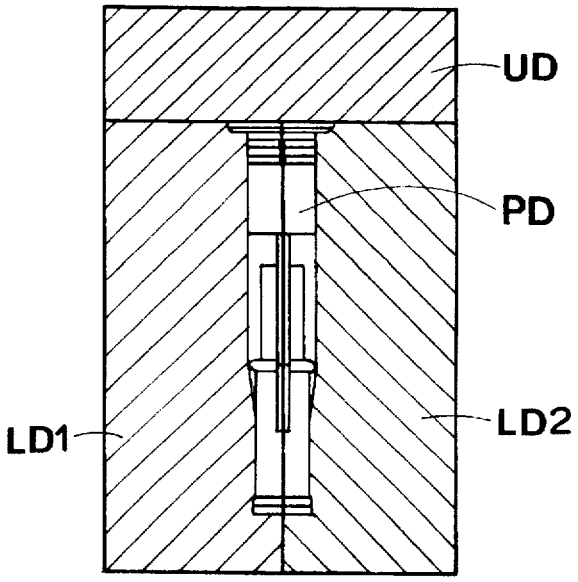
FIG. 13 PRIOR ART
FIG. 13 is a schematically sectional view of upper and lower dies for producing a prior plug socket.
Figure 14:
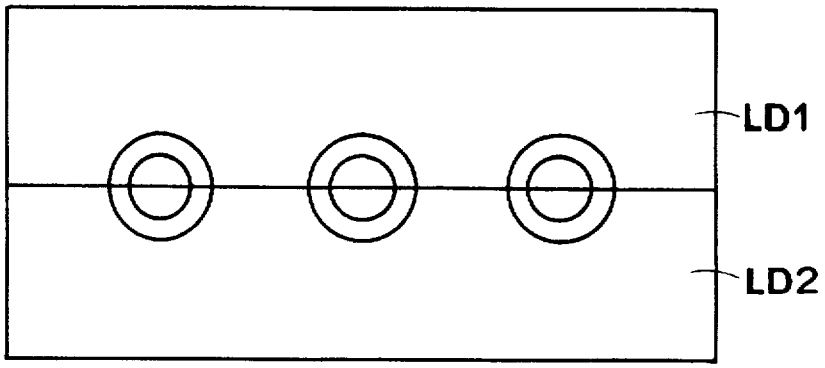
FIG. 14 PRIOR ART
FIG. 14 is a schematically plan view of the lower dies for producing a prior plug socket.
Figure 15:
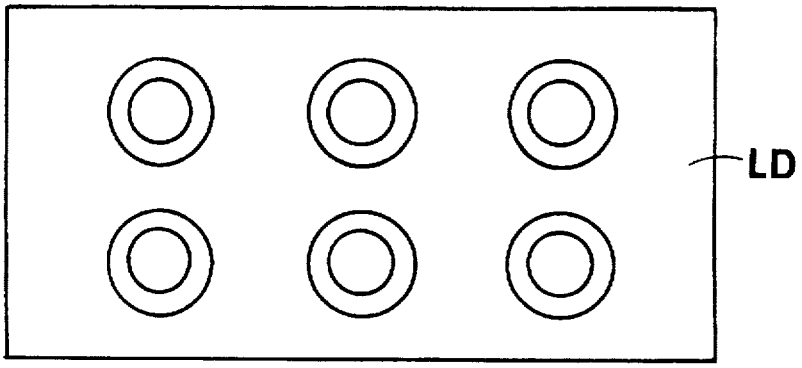
FIG. 15 is a schematically plan view of a lower die for producing a plug socket according to the embodiment of the present invention.

As for a prior method for manufacturing the plug socket as indicated by "PD", three dies for manufacturing the prior plug socket, i.e., an upper die "UD", left and right lower dies LD1, LD2, were used as shown in FIG. 13, so that only three products can be made by a single operation as shown in FIG. 14. According to the present embodiment, the plug socket 50 has such a structure as shown in FIGS. 10 and 11, so that a plurality of holes (six in this embodiment) for producing the plug socket 50 can be made on a lower die "LD" as shown in FIG. 15, and the products can be pulled out from the lower die "LD". Therefore, a plurality of products can be produced simultaneously by the upper die "UD" and the lower die "LD", i.e., six products in the present embodiment comparing with three products according to the prior method as shown in FIG. 14.

When the above-described ignition coil is installed in an internal combustion engine (not shown), the high-tension terminal 8 is directly connected with one ignition plug (not shown) through the plug socket 50, and the high-tension terminal 7 is connected with another ignition plug (not shown) through a high-tension cable (not shown). In operation, when a primary current is fed to the primary winding 12 and cut off, alternately, a counter electromotive force is induced in the secondary winding 22, so that such a high-tension as 30–40 kV is output to each ignition plug through the secondary terminals 23, 24, the connection terminals 25, 27 and the high-tension terminals 7, 8. As a result, a spark discharge is caused at an electrode of the ignition plug to ignite a compressed air-fuel mixture in a combustion chamber (not shown).

As described above, according to the present embodiment, the long shaft-like high-tension terminal 8 has the base end portion **8*b* which is held by at least three ribs 41, 42, 43 spaced apart evenly around its periphery. Therefore, the high-tension connector portion including the high-tension terminal 8 may be made simple in structure, and the number of parts may be reduced. Since the resin portion 9 is formed around the high-tension terminal 8, an adequate insulating property is ensured. The configuration of the ignition coil is made in conformity with the primary winding 10 and the secondary winding 20 which are received in the upper case 30, so that a portion indicated by hatching in FIG. 4 may be omitted from a prior ignition coil having an opening portion only on a side wall. The plug socket 50 may be produced by a small amount of material, and more than twice of the products can be produced simultaneously by means of only the upper and lower dies "UD" and "LD" thereby to reduce its cost. As describe above, the present embodiment relates to the simultaneous ignition coil provided with two high-tension terminals 7, 8, while it may be applied to a conventional ignition coil, with either one of the high-tension terminals 7, 8 and either one of the connection terminals 25, 26** employed for the conventional ignition coil.

It should be apparent to one skilled in the art that the above-described embodiment is merely illustrative of but one of the many possible specific embodiments of the present invention. Numerous and various other arrangements can be readily devised by those skilled in the art without departing from the spirit and scope of the invention as defined in the following claims.

What is claimed is:

1. An ignition coil for an internal combustion engine comprising:

a first case having a box-like configuration with at least an opening portion at a bottom of said first case;

a primary winding and a second winding received in said first case;

a secondary terminal electrically connected to said secondary winding and placed within said first case in the vicinity of the opening portion at the bottom of said first case;

a second case having a cover portion connected with the opening portion at the bottom of said first case for closing the opening portion, and a cylindrical portion extending from said cover portion;

a high-tension terminal having a shaft held on a central axis of said cylindrical portion of said second case, one end portion of said shaft being electrically connected to said secondary terminal in the vicinity of the opening portion of said first case; and a synthetic resin filled in said first case and said second case connected therewith for fixing and insulating said primary winding, said secondary winding, said secondary terminal and said high-tension terminal, said synthetic resin molding therein at least the one end portion of said shaft electrically connected to said secondary terminal.

2. An ignition coil for an internal combustion engine as set forth in claim 1, wherein said second case includes at least three ribs spaced apart evenly around an inner periphery of said cylindrical portion, said ribs extending from the inside of said cylindrical portion toward the central axis thereof, and holding said high-tension terminal on the central axis of said cylindrical portion.

3. An ignition coil for an internal combustion engine as set forth in claim 2, wherein said high-tension terminal has a boss portion extending out of said cover portion of said second case into said first case, and a base end portion held by said ribs.

4. An ignition coil for an internal combustion engine as set forth in claim 3, further comprising a connection terminal, one end thereof connecting to said secondary terminal, and an opposite end of said connection terminal extending toward the opening portion at the bottom of said first case, and connecting to said boss portion of said high-tension terminal.

5. An ignition coil for an internal combustion engine as set forth in claim 1, wherein said first case has at one side thereof an inlet opening portion through which said synthetic resin is filled into said first case and said second case connected therewith.

6. An ignition coil for an internal combustion engine as set forth in claim 1, further comprising a cylindrical insulating member for enclosing said cylindrical portion of said second case, an outer diameter of at least a part of said cylindrical insulating member being gradually reduced from one end thereof placed near said first case toward an opposite end of said cylindrical insulating member thereby to provide a tapered surface.

7. An ignition coil for an internal combustion engine as set forth in claim 6, wherein said cylindrical insulating member has a plurality of outer ribs spaced apart evenly around an outer periphery of said cylindrical insulating member, said outer ribs extending radially from the outside of said cylindrical insulating member.

* * * * *